United States Patent [19]

Fukuda et al.

[11] Patent Number: 4,608,518

[45] Date of Patent: Aug. 26, 1986

[54] COLOR FLUORESCENT LUMINOUS TUBE

[75] Inventors: Tatsuo Fukuda; Akiyoshi Ikenaga, both of Mobara, Japan

[73] Assignee: Futaba Denshi Kogyo K. K., Mobara, Japan

[21] Appl. No.: 738,350

[22] Filed: May 28, 1985

[30] Foreign Application Priority Data

May 28, 1984 [JP] Japan ..... 59-108092

[51] Int. Cl.[4] ..... H01J 29/94

[52] U.S. Cl. ..... 313/481; 313/495; 313/553

[58] Field of Search ..... 313/553, 481, 495, 558, 313/559, 560

[56] References Cited

U.S. PATENT DOCUMENTS

| | | | |
|---|---|---|---|
| 2,843,777 | 7/1958 | Szegho | 313/481 |
| 3,935,499 | 1/1976 | Oess | 313/495 |
| 4,220,893 | 9/1980 | Miller et al. | 313/481 |
| 4,431,939 | 2/1984 | Hernqvist | 313/481 |

*Primary Examiner*—Stewart J. Levy
*Assistant Examiner*—Hezron E. Williams
*Attorney, Agent, or Firm*—Oblon, Fisher, Spivak, McClelland & Maier

[57] ABSTRACT

A color fluorescent luminous tube is disclosed which is capable of eliminating a problem of cathode poisoning to significantly lengthen the life of the tube. The color fluorescent luminous tube includes getter devices provided to diffuse a part of a getter material toward luminous cells to deposit it as a film on regions adjacent to the luminous cells, so that the film catches impurity gas generated from the luminous cells due to the impingement of electrons thereupon before it reaches a cathode.

18 Claims, 12 Drawing Figures

COLOR FLUORESCENT LUMINOUS TUBE

BACKGROUND OF THE INVENTION

1. Field of the Invention

This invention relates to a color fluorescent luminous tube of the type of including a plurality of luminous cells, cathode filaments stretched opposite to the luminous cells, and control grids and shield grids arranged between the luminous cells and the cathode filaments, and more particularly to such a color fluorescent luminous tube which is adapted to effectively remove impurities generated in the luminous tube.

2. Description of the Prior Art

A picture cell luminous tube for a large-sized display or the like has been conventionally proposed which is typically constructed in such a manner as shown in FIG. 1. More specifically, the conventional picture cell luminous tube includes a plurality of luminous cells separated from one another by diffusion plates 2. The luminous cells 1 have phosphors of, for example, red, green and blue luminous colors deposited thereon, respectively. The picture cell luminous tube also includes a cathode filament 3 stretched above each of the luminous cells 1 to be opposite thereto and a control grid 4 and a shield grid 5 arranged between the luminous cell 1 and the cathode filament 3. In the picture cell luminous tube constructed in such a manner, the control grid 4 controls the passage of electrons emitted from the cathode 3 to allow only electrons for a region of the luminous cell 1 which is to emit light to selectively pass through the control grid 4. Then, the electrons pass through the shield grid 5 and then is subjected to the diffusion action of the diffusion plate 2 so that the electrons may uniformly impinge upon the overall surface of the luminous cell 1 to cause it to emit light.

Recently, a color fluorescent luminous tube constructed as described above has been extensively used in a variety of fields. Particularly, it is expected to be widely used as a picture cell for such a large-sized display device as represented by a super color television.

In order that a color fluorescent luminous tube can be effectively used as a picture cell for a super color television or the like, it is essential to keep an anode at high voltage to cause electrons to impinge on a luminous cell adjacent to the anode with a high speed. Otherwise, it fails to increase a luminous area and exhibit high luminance. However, in a conventional color fluorescent luminous tube as described above, when high speed electron beam impinges upon a luminous cell, phosphor deposited on the luminous cell such as, for example, $Y_2O_2S$:Eu of red luminous color, ZnS:CuAl of green luminous color, ZnS:Ag of blue luminous color or the like is decomposed due to the irradiation of the high speed electron beam to directly produce sulfide gas such as S, SO and/or $SO_2$ or cause sulfide gas trapped in the phosphor to ooze out. Alternatively, the produced gas chemically bonds to oxygen which is produced due to the decomposition of residual $H_2O$ by the high speed electron beam. Further, the irradiation of the high speed electron beam causes $H_2$, C, $Cl_2$ adhered to the wall of the luminous tube to be rendered free due to impingement of the beam thereon, resulting in sulfide gas such as S, SO, $SO_2$ or the like being generated from the surface of the luminous cell. The produced sulfide gas chemically bonds to a material coated on a cathode filament such as, for example, (Ba, Sr, CaO)Ba or adheres to the cathode filament, which results in deterioration of the electron emitting capacity of the cathode filament, to thereby cause a phenomenon called cathode poisoning and substantially reduce the life of the fluorescent luminous tube.

SUMMARY OF THE INVENTION

The present invention has been made in view of the foregoing disadvantage of the prior art, particularly, a problem of cathode poisoning occurring due to the restriction of structure of a color fluorescent luminous tube and taking notice of the fact that such a problem is effectively eliminated by incorporating a getter device in a fluorescent luminous tube.

Accordingly, it is an object of the present invention to provide a color fluorescent luminous tube which is capable of effectively eliminating a problem of cathode poisoning.

It is another object of the present invention to provide a color fluorescent luminous tube which is capable of substantially lengthening the life.

In accordance with the present invention, there is provided a color fluorescent luminous display comprising a plurality of luminous cells which emit lights different in luminous colors from one another upon impingement of electrons thereupon. The cathode filaments are stretched above the luminous cells to be opposite thereto and control grids and shield grids are arranged between the cathode filaments and the luminous cells. A grid holder is provided for supporting the shield grids thereon. The grid holder includes openings and getter devices are arranged adjacent to the openings of the grid holder to diffuse a getter material toward the luminous cells.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which.

DETAILED DESCRIPTION OF THE PREFERRED EMBODIMENTS

Now, a color fluorescent luminous tube according to the present invention will be described hereinafter with reference to FIGS. 2 to 8.

Figure 1A:
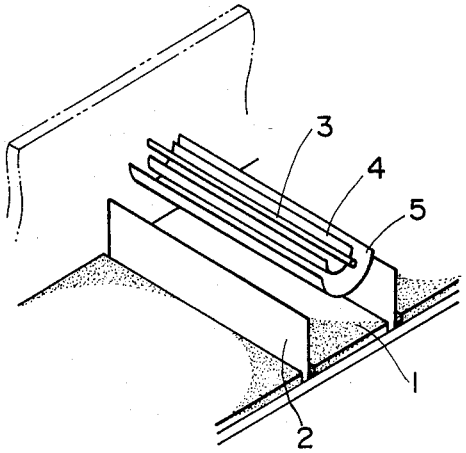
FIG.1(A) (PRIOR ART)
FIG. 1A is a schematic perspective view showing the basic structure of a conventional color fluorescent luminous tube.
Figure 1B:
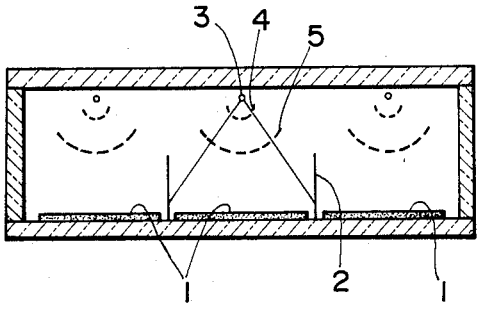
FIG.1(B) (PRIOR ART)
FIG. 1B is a vertical sectional view of the color fluorescent luminous tube shown in FIG. 1.
Figure 2:
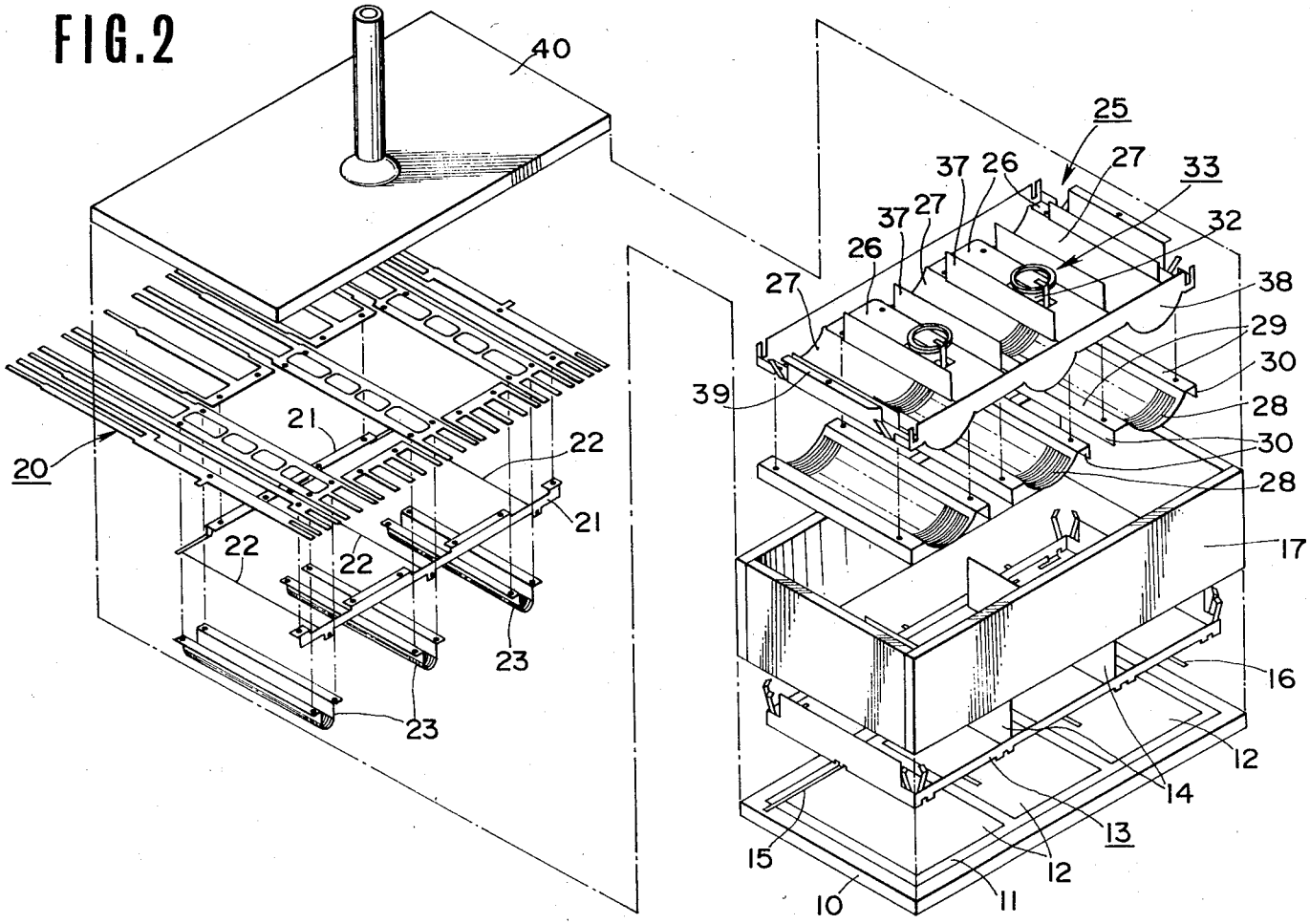
FIG. 2 is an exploded perspective showing an embodiment of a color fluorescent luminous tube according to the present invention.

FIG. 2 shows an embodiment of a color fluorescent luminous tube according to the present invention. A color fluorescent luminous tube of the illustrated embodiment includes a display plate 10 and a frame-like anode 11 arranged on the display plate 10 which is formed of a conductive material such as graphite into a film. The anode 11 has a plurality of phosphors of different types, for example, $Y_2O_2S$:Eu of red luminous color, ZnS:CuAl of green luminous color and ZnS:Ag of blue luminous color deposited thereon. The phosphors each are applied thereto an intermediate film of lacquer or the like for smoothing the surface of the phosphor. On the surface of the phosphor, a metal backing made of a deposited Al film is formed so as to provide a plurality of luminous cell 12. The color fluorescent luminous device further includes a diffusion plate frame 13 arranged on the display plate 10 and electrically connected to the frame-like anode 11. The diffusion plate frame 13 is provided with a plurality of diffusion plates 14, which are positioned between the respective adjacent luminous cells 12 as clearly shown in FIG. 3 to separate the luminous cells 12 from one another. Reference numeral 15 designates an anode lead wire led out from the anode 11 and reference numeral 16 designates a mounting pin which is securely interposed between the display plate 10 and vertical side plates 17 to fix the diffusion plate frame 11 on the display plate 10.

Also, the color fluorescent luminous tube of the illustrated embodiment, as viewed on the left of FIG. 2, includes a lead frame 20 and a pair of cathode supporting members 21 mounted on the lower surface of the lead frame 20, for example, by welding. Between the cathode supporting members 21, cathode filaments 22 are stretched at the positions opposite to the luminous cells 12. Reference numeral 23 designates control grids of an arcuate shape in section mounted on the lead frame 20 so as to surround the corresponding cathode filaments 22.

Figure 5:
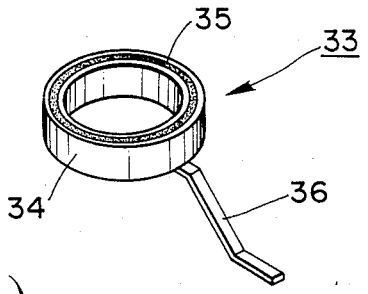
FIG. 5 is a perspective view showing a getter device constituting the essential part of the color fluorescent luminous tube shown in FIG. 2.

Further, the color fluorescent luminous tube, as viewed on the right of FIG. 2, includes a shield grid holder 25 having planar portions 26 each of which is formed with a window 27 for a shield grid. On the lower side of each of the windows 27 is mounted a shield grid 28 of an arcuate shape in section by spot welding or the like. The shield grids 28 each have a pair of mounting portions 29 which are provided with shields 30, respectively. The shields 30 may be formed by downward bending side ends of the mounting portions 29 so as to downward project therefrom. The planar portions 26 of the grid holder 25 each are formed with an opening 32, above which a getter device 33 is arranged. The getter device 33, as shown in FIG. 5, comprises a holder 34 formed of iron into a ring shape and a getter material 35 formed of, for example, a compressed powder of Ba-Al alloy and surroundedly held in the holder 34. The holder 34 is mounted through a mounting member 36 into alignment with the opening 32. The window 27 of the grid holder 25 is provided on both sides thereof with partitions 37, which may be formed by, for example, raising both side end portions of the window 27. Also, the grid holder 25 is provided on both sides thereof with longitudinally extending shield plates 38.

Figure 3:
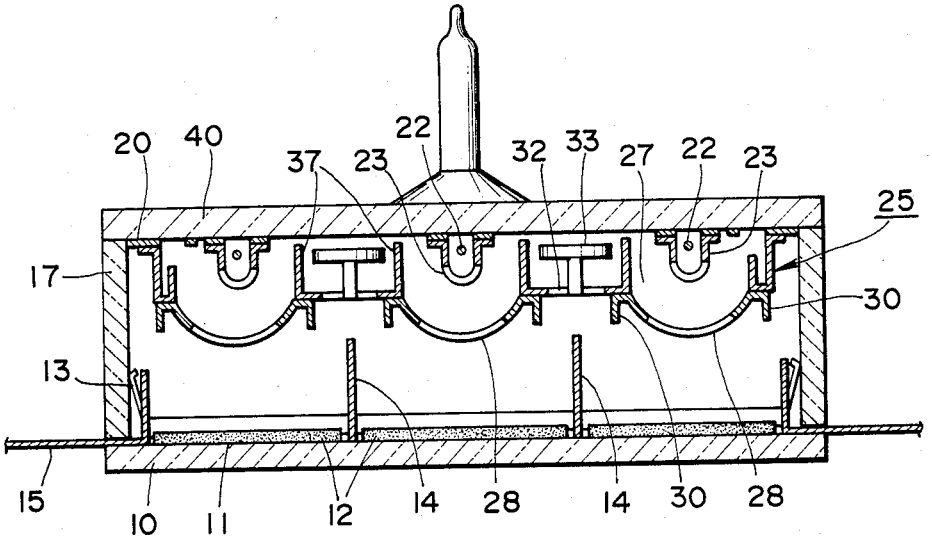
FIG. 3 is a vertical sectional view of the color fluorescent luminous tube shown in FIG. 2.
Figure 4:
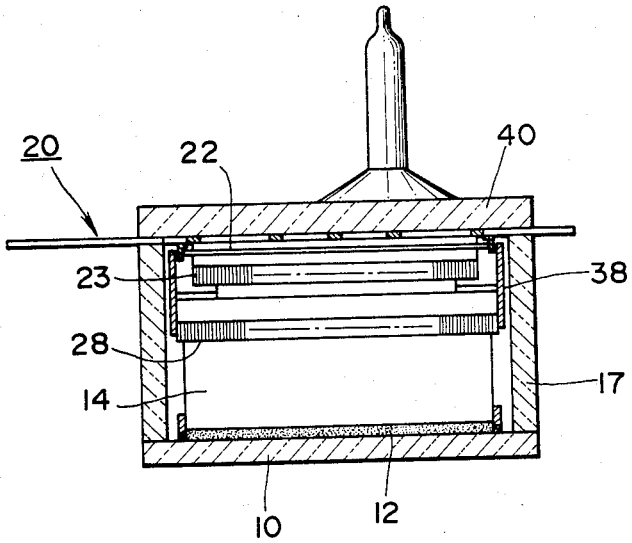
FIG. 4 is a cross sectional view of the color fluorescent luminous tube shown in FIG. 2.

The grid holder 25 on which the shield grids 28 are mounted is connected through the mounting portions 39 thereof to the lead frame 20, and the lead frame 20 is securely interposed between the side plates 17 and rear plates 40. At this time, as shown in FIG. 3, the shield grids 28 each are positioned to concentrically cover the corresponding control grid 23 and be opposite to the luminous cell 12. Further, the openings 32 of the grid holder 25 and the getter devices 33 are positioned just above the corresponding diffusion plates 15, and the shields 30 of each of the shield grids 28 are positioned so as to be upward spaced from the adjacent diffusion plates 14.

In the color fluorescent luminous tube of the illustrated embodiment described above, when the ring-shaped holders 34 of the getter devices 33 are subjected to high frequency heating after the assembling and sealing of the tube, the getter material (Ba) 35 received in the holders 34 is vaporized and upward diffused. The getter material is then deposited on the lower surface of the rear plate 40 to form a getter film. At this time, a part of the getter material 35 is downward directed directly from central openings of the ring-shaped holders 34 or the periphery thereof or after the impingement upon the lower surface of the rear plate 40 and is guided along the partitions 37 of the grid holder 25. Then, the getter material passes through the openings 32, downward flows along both sides of the diffusion plates 14, and reaches the position above the luminous cells 12, during which the getter material 35 impinges on both side surfaces of each of the diffusion plates 14 and the portion of each luminous cell 12 adjacent to the diffusion plates 14. Accordingly, a getter film may be depositedly formed on such regions.

The getter film formed on the diffusion plates 14 and the portions of the luminous cells adjacent to the diffusion plates 14 serves to adsorptively catch, in the proximity of the luminous cells 12, sulfide gas such as S, SO, $SO_2$ and the like generated from the luminous cells 12 due to the impingement of high speed electron beam, to thereby effectively remove the gas. Further, the getter film deposited on the lower surface of the rear plate 40 acts to adsorptively catch gas remaining in the tube such as $H_2O$, CO, $CO_2$ and the like.

As described above, the getter film is formed on the portions of the luminous cells 12 adjacent to the diffusion plates 14. However, this does not adversely affect the luminous function of the luminous cells 12 so far as the amount of deposition of the getter material is suitably adjusted.

Figure 6A:
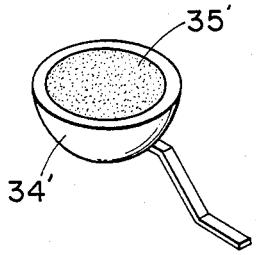
FIG. 6A is a perspective view showing a modification of a getter device.
Figure 6B:
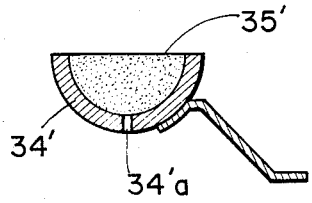
FIG. 6B is a sectional view of the getter device shown in FIG. 6A.
Figure 7A:
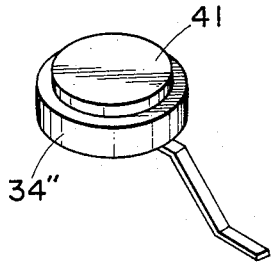
FIG. 7A is a perspective view showing another modification of a getter device.
Figure 7B:
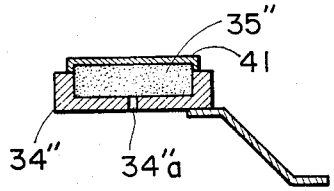
FIG. 7B is a sectional view of the getter device shown in FIG. 7A.
Figure 8A:
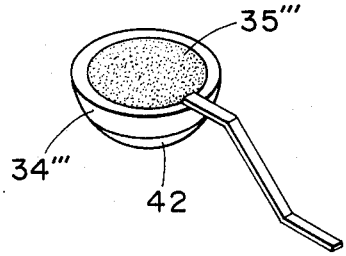
FIG. 8A is a perspective view showing a further modification of a getter device.
Figure 8B:
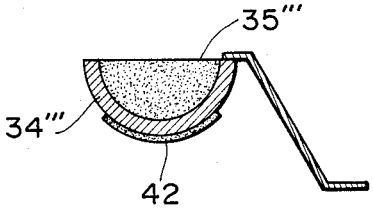
FIG. 8B is a sectional view of the getter device shown in FIG. 8A.

In the illustrated embodiment, the holder 34 of the getter device 33 is formed into a ring-like shape. However, it is not limited to such a specific shape so far as it has a shape which allows the getter material vaporized to be directed in both the upward and downward directions. For example, the holder 34 may be formed into such a shape as shown in FIG. 6. A holder 34' shown in FIG. 6 is formed into a semi-spherical shape. The holder 34' is formed at the lower portion thereof with an opening **34*a*' and holdingly receives therein a getter material 35' formed of a compressed powder. The downward diffusion or dispersion of the getter material 35' vaporized is carried out through the opening 34*a*' and the amount of downward diffusion of the getter material is suitably controlled depending upon the selection of diameter of the opening 34a'. Alternatively, the holder may be formed into such a shape as shown in FIG. 7. A holder 34'' shown in FIG. 7 is adapted to hold therein a getter material 35'' of a pellet-like sintered compact. A metal mesh 41 is arranged to prevent the getter material 35' from dropping. Further, a holder 34''' shown in FIG. 8 may be used in the present invention, wherein a getter material 42 for downward diffusion is applied on the lower outer surface of the holder 34'''. In the holder 34''', the amount of downward diffusion of the getter material 42 is suitably controlled depending upon the amount of application of the material 42** onto the holder.

As described above, the getter material is diffused or dispersed with kinetic energy imparted thereto at the time of the vaporization. Accordingly, a part of the getter material is directed toward the luminous cells due to the turning after the impingement upon the lower surface of the rear plate 40. Thus, it will be noted that the holder is never limited to any specific shape.

As described above, the color fluorescent luminous tube is constructed in the manner that the getter devices are provided above the openings of the grid holder provided so as to be positioned just above the diffusion plates for separating the luminous cells from one another. When the getter material held in the getter devices are vaporized by heating, the downward diffused getter material downward flows through the openings along the diffusion plates, during which the getter film is formed on the diffusion plates and the portions of the luminous cells adjacent to the diffusion plates. Thus, undesired impurity gas generated from the luminous cells due to the impingement of high speed electron beam thereupon is effectively caught by the getter film in the proximity of the source before it contacts with the cathode filaments. Accordingly, the problem of cathode poisoning may be positively eliminated to significantly lengthen the life of the fluorescent luminous tube.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A color fluorescent luminous tube comprising:

a display plate;

an anode arranged on said display plate;

a plurality of luminous cells deposited on said anode, said luminous cells emitting different luminous colors from one another upon impingement of electrons thereupon;

a cathode filament stretched above each of said luminous cells to be opposite thereto;

a control grid arranged between each of said cathode filaments and said luminous cells;

a shield grid holder mounted between said control grids and said luminous cells, said shield grid holder being provided with windows and openings;

a shield grid mounted on each of said windows to be opposite to said luminous cell, control grid and cathode filament; and a getter means for diffusing a getter material to form a getter film within said luminous tube, said getter means being arranged adjacent to each of said openings and lain in a plane substantially parallel to said cathode filament.

2. The color fluorescent luminous tube as defined in claim 1, wherein said luminous cells include phosphors of red luminous color, green luminous color and blue luminous color.

3. The color fluorescent luminous tube as defined in claim 2, wherein said phosphor of red luminous color consists of $Y_2O_2S$:Eu.

4. The color fluorescent luminous tube as defined in claim 2, wherein said phosphor of green luminous color consists of ZnS:CuAl.

5. The color fluorescent luminous tube as defined in claim 2, wherein said phosphor of blue luminous color consists of ZnS:Ag.

6. The color fluorescent luminous tube as defined in claim 1, wherein said luminous cells are separated from one another by diffusion plates.

7. The color fluorescent luminous tube as defined in claim 1, wherein said control grid is of arcuate in section.

8. The color fluorescent luminous tube as defined in claim 1, wherein said shield grid is of arcuate in section.

9. The color fluorescent luminous tube as defined in claim 6, wherein said diffusion plates extend vertically in alignment with said openings and said getter means.

10. The color fluorescent luminous tube as defined in claim 1, wherein said getter means is positioned between each two adjacent control grids.

11. The color fluorescent luminous tube as defined in claim 1, wherein said shield grid holder is provided with partitions on both sides of said window.

12. The color fluorescent luminous tube as defined in claim 1, wherein said getter means comprises a ring shaped getter material holder, a getter material surroundedly held in said holder and a mounting member for said holder.

13. The color fluorescent luminous tube as defined in claim 1, wherein said getter means comprises a semispherical shaped getter material holder having an opening at the lower portion thereof, a getter material held in said holder, and a mounting member for said holder.

14. The color fluorescent luminous tube as defined in claim 1, wherein said getter means comprises a disc shaped getter material holder having an opening at the lower portion thereof, a getter material held in said holder, and a mounting member for said holder.

15. The color fluorescent luminous tube as defined in claim 1, wherein said getter means comprises a semispherical shaped getter material holder, a getter material held in said holder, a getter material applied on the lower outer surface of said holder, and a mounting member for said holder.

16. The color fluorescent luminous tube as defined in one of claims 12–15, wherein said getter material is a compressed powder.

17. The color fluorescent luminous tube as defined in one of claims 12–15, wherein said getter material is a pellet-like sintered compact.

18. The color fluorescent luminous tube as defined in claim 17, further comprising a metal mesh to cover said getter material for preventing the same from dropping.

* * * * *